US007299760B2

(12) United States Patent
Boatman et al.

(10) Patent No.: US 7,299,760 B2
(45) Date of Patent: Nov. 27, 2007

(54) FLOATING LNG IMPORT TERMINAL AND METHOD FOR DOCKING

(75) Inventors: L. Terry Boatman, Houston, TX (US); Yonghui Liu, Houston, TX (US)

(73) Assignee: Sofec, Inc., Houston, TX (US)

( * ) Notice: Subject to any disclaimer, the term of this patent is extended or adjusted under 35 U.S.C. 154(b) by 312 days.

(21) Appl. No.: 11/072,576

(22) Filed: Mar. 4, 2005

(65) Prior Publication Data

US 2005/0193938 A1 Sep. 8, 2005

Related U.S. Application Data

(60) Provisional application No. 60/550,879, filed on Mar. 5, 2004, provisional application No. 60/554,473, filed on Mar. 18, 2004.

(51) Int. Cl.
*B63B 21/50* (2006.01)
*B63B 35/44* (2006.01)

(52) U.S. Cl. ..... 114/230.12; 114/230.13; 114/256; 114/265; 114/293; 441/3; 405/203; 405/224

(58) Field of Classification Search ..... 114/230.1, 114/230.12, 230.13, 256, 264, 265, 293; 441/3–5; 405/195.1, 203–210, 224
See application file for complete search history.

(56) References Cited

U.S. PATENT DOCUMENTS 2,699,321 A * 1/1955 Nelson ..... 175/8
3,839,977 A * 10/1974 Bradberry ..... 114/256
4,098,212 A 7/1978 Kemper et al.
4,317,474 A 3/1982 Kentosh
4,494,475 A 1/1985 Eriksen
4,753,185 A * 6/1988 Salusbury-Hughes .... 114/61.13
5,279,240 A * 1/1994 Worley ..... 114/74 T
6,546,739 B2 4/2003 Frimm et al.

(Continued)

FOREIGN PATENT DOCUMENTS

JP 53114190 A * 10/1978

(Continued)

*Primary Examiner*—Ajay Vasudeva
(74) *Attorney, Agent, or Firm*—Gary L. Bush; Andrews Kurth LLP

(57) ABSTRACT

A floating terminal for offloading an LNG carrier vessel in the sea. The floating terminal of open frame construction is moored toward its front end with a rotatable mooring arrangement so that the terminal may weathervane in response to environmental forces. Marine thrusters are provided at the aft end of the terminal for swinging the terminal away from and back toward a line defined by the path toward the terminal of an approaching LNG carrier. Offloading equipment and heat exchangers are provided on a deck of the floating structure. When an LNG carrier vessel approaches the terminal, the thrusters swing the floating terminal away from the carrier vessel approach line while a hawser at the front end of the terminal pulls the vessel close to the terminal. The floating terminal swings back toward the carrier vessel in response to operating the marine thrusters in an opposite direction until the carrier vessel and floating terminal are side-by-side. The hawser continues to pull the carrier vessel forward with respect to the terminal until loading arms at the side of the terminal are aligned side-by-side with a manifold of the carrier vessel.

16 Claims, 14 Drawing Sheets

U.S. PATENT DOCUMENTS

Figure 1A:
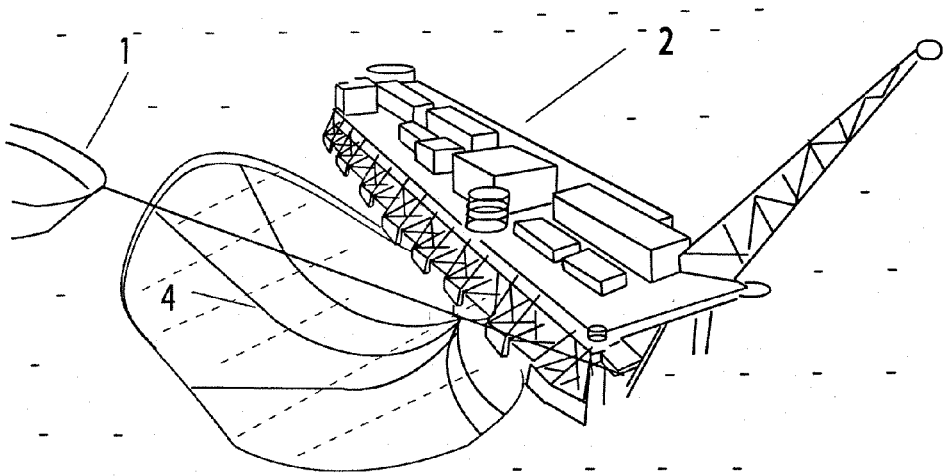

| | | | | |
|---|---|---|---|---|
| 7,101,118 | B2 * | 9/2006 | Brinkel et al. | 405/203 |
| 7,107,925 | B2 * | 9/2006 | Wille et al. | 144/230.15 |
| 7,179,144 | B2 * | 2/2007 | De Baan | 441/5 |
| 2003/0206671 | A1 | 11/2003 | Poldervaart | |
| 2005/0204987 | A1 * | 9/2005 | Baan | 114/230.27 |

FOREIGN PATENT DOCUMENTS

| | | | |
|---|---|---|---|
| JP | 59170316 A | * | 9/1984 |
| JP | 59184087 A | * | 10/1984 |
| WO | WO 8201859 A | * | 6/1982 |
| WO | WO 03/033341 | | 4/2003 |
| WO | WO 03/049994 | | 6/2003 |
| WO | WO 03/093099 | | 11/2003 |

* cited by examiner

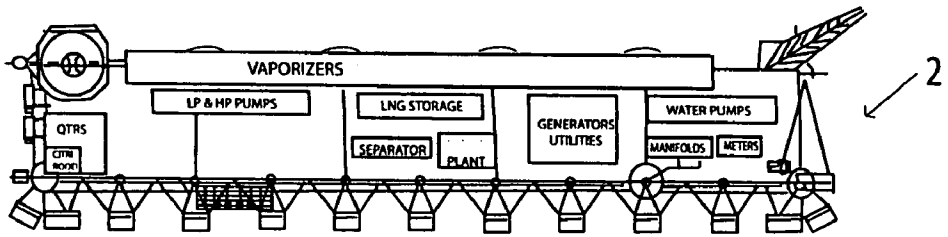
Fig 2a
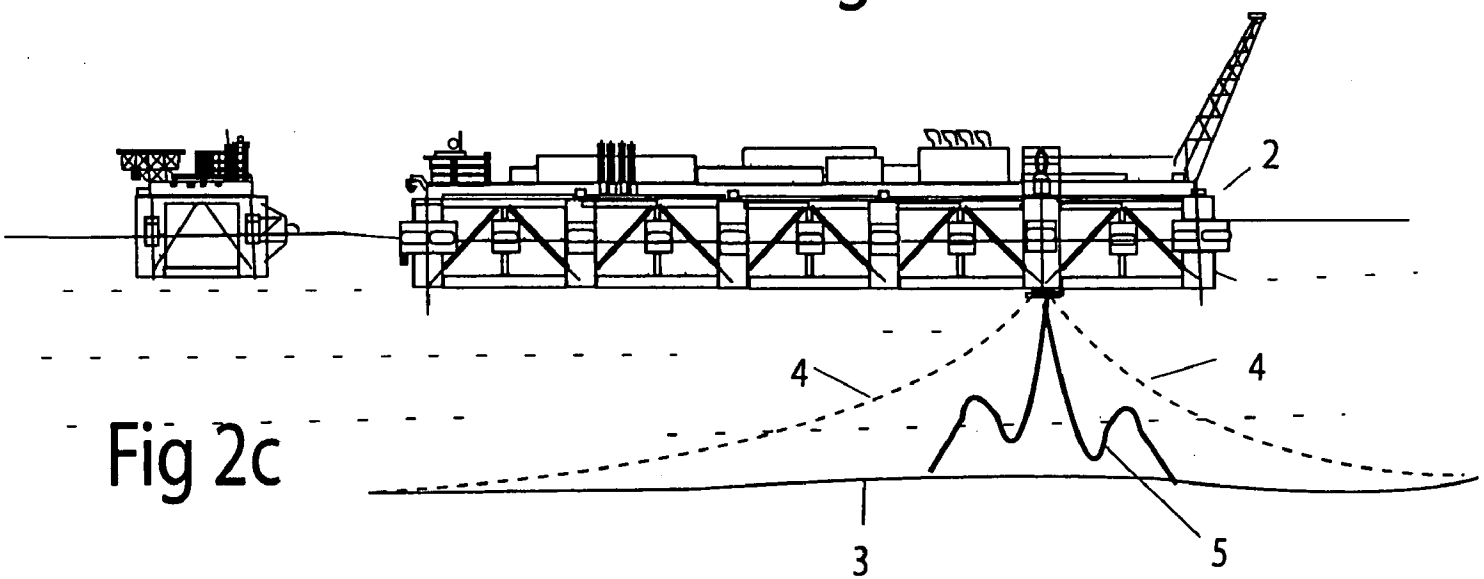
Fig 2b
Fig 2c

FLOATING LNG IMPORT TERMINAL AND METHOD FOR DOCKING

CROSS REFERENCE TO RELATED APPLICATIONS

This non-provisional application claims priority from Provisional Application 60/550,879 filed Mar. 5, 2004 and 60/554,473 filed Mar. 18, 2004.

BACKGROUND OF THE INVENTION

1. Field of the Invention

The rapidly rising demand for energy in many countries requires an increasing level of importation of liquefied natural gas (LNG). This invention relates generally to LNG import terminals that are located offshore in water depths suitable for ship navigation. More specifically the invention concerns an LNG import terminal of open frame construction that can weathervane about a rotatable mooring structure at one end and can be rotated away from or toward a path of a docking carrier vessel to the terminal in response to operation of thrusters located at the opposite end of the terminal. Still more specifically, the invention concerns an offshore docking facility that is used advantageously in conjunction with the underground storage of hydrocarbon gas either in salt dome caverns or in depleted sulfur domes.

2. Description of the Prior Art

A common example of prior docking arrangements for two vessels at sea is the side-by-side mooring of two conventional hull vessels, i.e., mooring the carrier vessel to a converted oil tanker hull. Such an arrangement is disclosed in U.S. Pat. No. 6,546,739 of Frimm, et al issued Apr. 5, 2003. The converted oil carrier has an LNG regasification plant mounted thereon and is moored to an external single point mooring buoy. Such a converted hull vessel is commonly used offshore, but is limited to relatively benign sea-states because of excessive relative motion between the terminal vessel and a carrier vessel secured to its side. Larger sea-states cause large forces to occur between the vessels and pose a significant safety risk to the operation. Not only do both vessels react individually to the environmental loads, there is a coupling effect between the two vessels that may amplify the motions. This coupling action makes the prediction of the vessel motions and forces difficult with existing analytical numerical methods.

Numerous US and foreign patents describe a multitude of side-by-side vessel loading methods, and several variations of floating LNG regasification units. The following patents and published applications show various side-by-side loading arrangements and methods: US 2003/0206771, of Poldervaart, on Nov. 6, 2003; WO 03/093099 A1, of Poldervaart on Nov. 13, 2003; WO 03/049994 A1, of Wille on Jun. 19, 2003; WO 03/033341 A1, of De Baan on Apr. 24, 2003; U.S. Pat. No. 6,546,739, of Frimm et al. on Apr. 15, 2003; U.S. Pat. No. 4,494,475, of Tor Eriksen on Nov. 1, 1982; U.S. Pat. No. 4,317,474, of Kentosh on Mar. 3, 1980; U.S. Pat. No. 4,098,212, of Kemper on Feb. 17, 1977; and U.S. Pat. No. 3,908,576, of Van der Gaag on Sep. 30, 1975.

3. Objects of the Invention

The primary objects of this invention are to provide:

a. An offshore floating import terminal for the purpose of offloading LNG carrier vessels and for and the purpose of pressurizing and warming the LNG to a dense phase gas state prior to transfer of the gas to a subsea gas pipeline and/or to an underground storage cavern.

b-1. An improved offshore floating import terminal as described in paragraph (a) above, except that: (1) the warmed gas is exported from the floating terminal to only a sales gas pipeline; (2) no LNG or gas storage is provided off of the floating terminal; and (3) the floating terminal does not have significant on-board storage of LNG.

b-2. An improved offshore floating import terminal as described in paragraph (b-1) above, except that the floating terminal does have significant on-board storage of LNG transferred from a carrier vessel, where LNG is applied to regasification equipment on the floating import terminal from on-board storage tanks.

c. An improved offshore floating import terminal as described in paragraph (a) above, except: (1) the warmed gas is exported from the floating terminal to only a sales gas pipeline; (2) large insulated tanks with a capacity of at least 20,000 m3 of LNG are provided on board the floating terminal; and (3) no LNG or gas storage is provided off of the floating terminal before the gas reaches the coastal shoreline.

d. An improved offshore floating terminal facility for the purpose of offloading LNG carrier vessels at LNG transfer rates of at least 1500 m3/hr and scalable for offloading rates upward of 15,000 m3/hr in a side-by-side (SBS) mooring arrangement.

e. An improved offshore floating terminal facility for the purpose of offloading LNG carrier vessels at LNG transfer rates of at least 1500 m3/hr and scalable for offloading rates upward of 15,000 m3/hr in a side-by-side (SBS) mooring arrangement, wherein conventional LNG loading arms are used for transferring LNG, and wherein utilization of the conventional loading arms do not require substantial modification of the LNG carrier's cargo side manifold piping where conventional loading arms are used such as those presently manufactured by FMC Loading Systems of Sens, France.

f. A dock structure that, because of its open frame construction, minimizes the relative motions between the floating dock and the moored LNG carrier such that relative motions are less than would occur between two conventional vessel hulls connected together in a side-by-side arrangement.

g. A floating structure that due to its inherent design has substantially less motion than an equal length conventional hull (such as a converted oil tanker hull) when subjected to environmental forces acting on the floating body.

h. A structural arrangement that minimizes the coupling effects between the dock structure and the SBS moored LNG carrier, and has substantially less relative motion than would occur between two conventional hull vessels moored side-by-side.

i. A floating terminal facility that is single point moored by an internal mooring turret, thereby allowing weathervaning with the environmental forces of wind, waves and sea current where the internal turret is located at an optimal point aft of the forward end of the dock, the distance from the forward end being in a range between about 0% to 30% of the dock overall length.

j. Powered maneuvering capability of the dock to facilitate a safer approach and side-by-side mooring of the LNG carrier to the dock where reversible marine thrusters on the aft end of the dock serve to swing the dock around the single point mooring.

k. A floating terminal facility with (1) an internal turret mooring located near one side of the dock structure, near the side at which the LNG carrier vessel is moored, i.e., not located near the centerline of the dock and not located near the centerline of the moored LNG carrier;

(2) a ship pull-in hawser fairlead located at a point on the forward end of the dock and near the dock's side adjacent to the LNG carrier so as to improve the operational safety of mooring the ship to the dock;

(3) all of the power generation and process equipment is mounted on the floating terminal; and (4) a diffuser for the heat exchanger cold seawater water outlet arranged to discharge in a way that provides (a) beneficial thrust force to assist the dock structure in remaining in contact with the LNG carrier, and (b) to discharge the cold sea water transverse to the platform and to the current in order to improve disposal of the cold sea water.

1. An improved offshore floating import terminal with an open frame construction including a column stabilized floating platform, a type construction known in the offshore industry for the construction of semi-submersible drilling platforms, but with dimensions and locations of the buoyant columns and pontoons arranged and designed specifically to provide enhanced floating stability and reduced motions of the platform as compared to those of a conventional shape.

SUMMARY OF THE INVENTION

The objects identified above along with other features and advantages of the invention are incorporated in several embodiments of an improved floating LNG terminal comprising a weathervaning single point moored dock that is arranged to increase the safety of the procedure for connecting the LNG carrier to the dock and an open frame structural arrangement to reduce the relative vessel motions while the carrier is being offloaded. An open frame dock or import terminal is arranged and designed to dock an LNG carrier. The arrangement of the open structure frame serves to significantly reduce both the independent and coupled effect motions of the dock and the LNG carrier. The advantage of this improvement over prior docking arrangements for two vessels at sea is to allow the terminal system to be operated safely in a more severe sea-state, thereby increasing the availability of the terminal for offloading LNG carriers.

According to a deep water mooring embodiment, a mooring turret is located to one side of the dock frame, with a hawser fairlead sheave mounted forward of the mooring turret, and aft marine thrusters provided for swinging the dock away from the approaching LNG carrier vessel. Such an arrangement provides safety improvements, as compared to prior arrangements for docking two vessels at sea during the process of mooring the LNG carrier to the dock.

According to a shallow water mooring embodiment, an open frame dock arrangement is combined with a soft yoke mooring and a stationary structural frame anchored to the sea floor.

According to an alternative embodiment of the invention, a disconnectable mooring turret for the terminal is provided with, for example, a disconnectable buoy substituted for the chaintable on the bottom of the turret. Such an arrangement provides for a quick disconnection of the terminal for situations such as along the east coast of Canada which may require that the floating terminal be disconnectable in the event of an approaching iceberg, severe sea ice, or severe weather.

According to another embodiment of the invention, the open frame docking terminal is combined with an external mooring turret. Such an arrangement may be cost effective and advantageous under certain conditions of water depth and environmental forces.

Another alternative embodiment of the invention includes a floating LNG terminal including a column stabilized floating platform structure, a single point mooring system secured to the sea floor, regasification equipment that utilizes seawater for warming the LNG, and at least one cryogenic tank for storage of liquefied natural gas (LNG), wherein LNG being unloaded from the LNG carrier vessel is stored temporarily in the cryogenic tank prior to its regasification.

DESCRIPTION OF PREFERRED EMBODIMENTS OF THE INVENTION

The invention is described by reference to the attached Figures where reference numbers are identified as follows:

1 LNG Carrier
2 Floating LNG Terminal
3 Seafloor
4 Anchor leg(s)
5 Flexible conductor(s)
6 Chaintable
7 Mooring turret
8 Gas and fluid swivel stack
9 Process equipment
10 LNG loading arms
11 Crew quarters
12 Control room
13 Marine thruster
14 Helipad
15 Lifeboat(s)
16 Blast wall(s)
17 Pneumatic fender
18 Fender support(s
19 Dock frame
20 Column
21 Diagonal structural member(s)
22 Horizontal structural member(s), pontoons
23 Drop-in deck section
24 Loading arm deck
30 Hawser pull-in winch system
31 Hawser
32 Aft swing arc
33 Reference line tangent to LNG carrier side
34 Arc of travel of fender
35 Tugboat
36 LNG carrier manifold
37 Arc of travel of LNG loading arms
38 Mooring line(s)
39 Hawser fairlead
40 Hawser sheave
41 Winch
42 Fairlead support
43 Flare boom
50 Seafloor
51 Tower
52 Turntable
53 Yoke
54 Support structure FIG. 1*a* shows LNG carrier 1 approaching a floating terminal 2 according to the invention. Below the sea surface, anchor legs 4 and flexible conductors 5 extend from the sea surface to a turret which is rotatably supported in a well of the terminal 2.

Figure 1B:
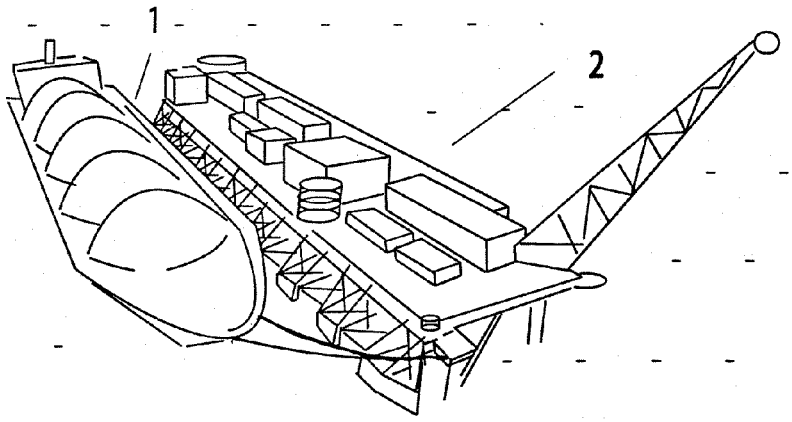

FIG. 1*b* illustrates LNG carrier 1 moored side by side to floating LNG terminal 2.

Figure 1C:
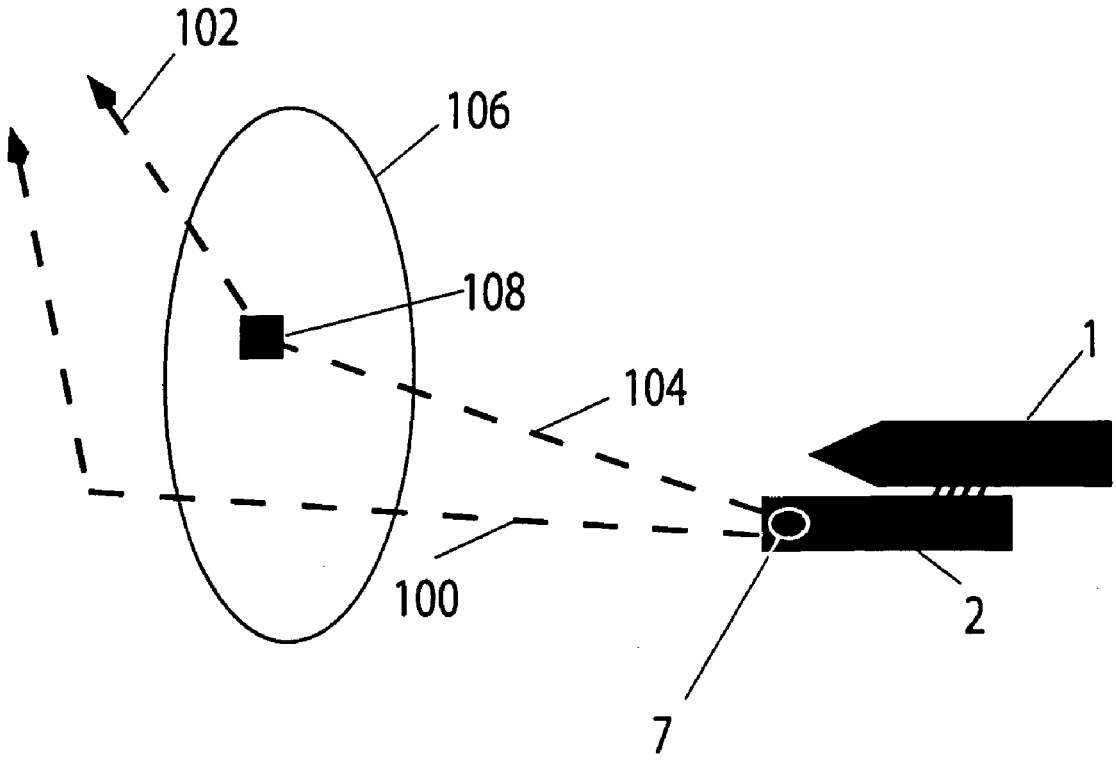

FIG. 1*c* shows a general arrangement of an LNG carrier moored to the floating terminal and their relationship with gas pipelines 100, 102 to shore and pipeline 104 between the LNG terminal 2 and underground storage caverns 106. The floating weathervaning dock 2 is provided with a heat exchanger, pumps and generators. Weathervaning is possible because of the mooring turret 7 is anchored to the sea floor. A small platform 108 at the gas storage cavern 106 may be provided for a drilling rig and gas control. A subsea wellhead may also be provided.

FIG. 2*a*, 2*b* and 2*c* present three general arrangement views of a first embodiment of the LNG terminal 2. In this first embodiment, LNG is transferred directly from a moored carrier vessel (not shown) to regasification equipment on the LNG terminal. FIG. 2*a* is a top plan view, FIG. 2*b* is a side elevation view, and FIG. 2*c* is an end view looking at the aft end of the dock. A pattern of at least three anchor legs 4 connects floating terminal 2 to seafloor 3. A system of flexible conductors 5 carry gas, fluids, and control signals from terminal 2 to seafloor pipelines. These pipelines (see the schematic illustration of FIG. 1*c*) transport the gas, and fluids to sales gas pipelines or to connection to underground storage caverns. The mooring turret 7 of FIGS. 2*a* and 2*b* is an internally mounted turret 7, but alternatively, turret 7 can be mounted externally off the forward end of the terminal 2. Such an arrangement may be cost effective and offer advantages under particular water depth and environmental conditions.

Figure 3A:
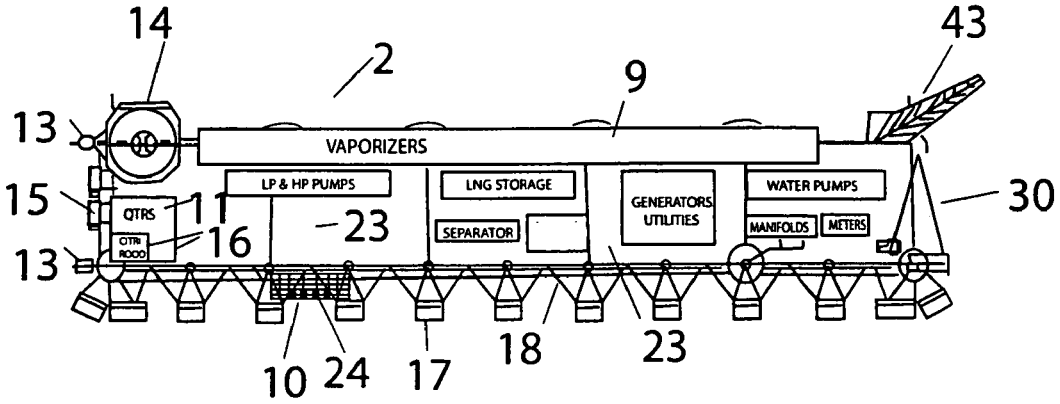
Figure 3B:
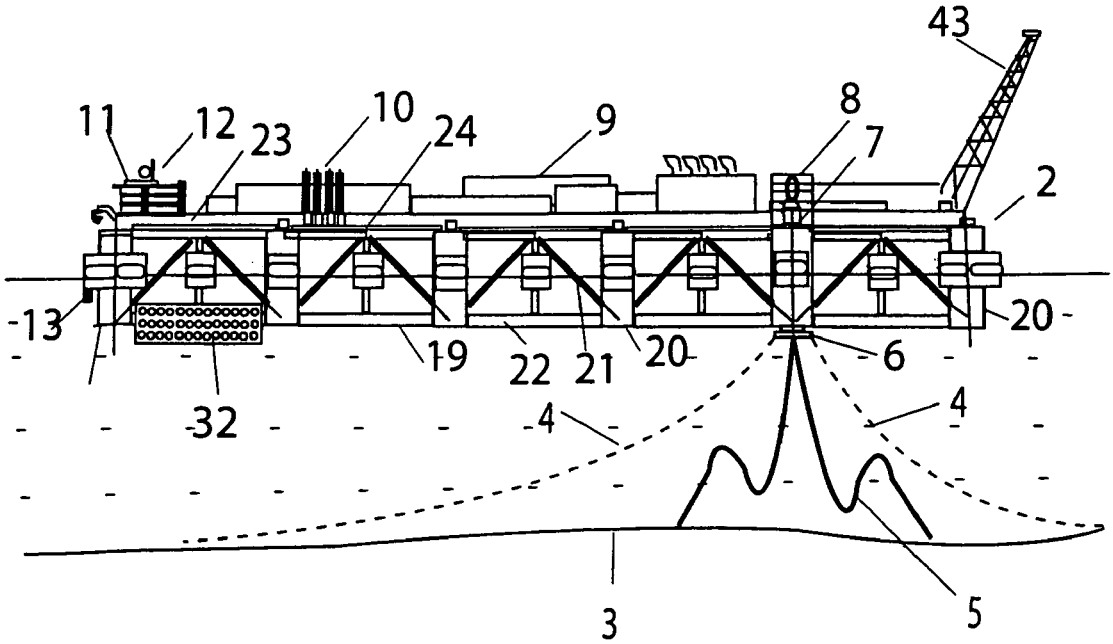

FIGS. 3*a* and 3*b* provide enlarged views of floating terminal 2 of FIGS. 2*a*-2*c*. LNG loading arms 10 transfer LNG to the process equipment 9. Process equipment 9 can, for example, include LNG pumps, vaporizers (alternatively named heat exchangers, or warmers), LNG storage for operation of the LNG pumps and for fuel supply, generators, water pumps, gas metering, and the like. A gas flare boom 43 is mounted on the forward end. Crew quarters 11, control room 12, helipad 14, and lifeboats 15, are located on the aft end of terminal 2 for safety. Blast walls 16 surround and shield crew quarters 11 and control room 12 from effects of explosion on board terminal 2 or on vessel 1.

FIG. 3*b* shows the anchor legs 4 connected to sea floor 3, and their upper end attached to chaintable 6. Flexible fluid conductors 5 (also commonly called flexible risers) are attached at their upper end to chaintable 6. At least one conductor 5 carries compressed gas from terminal 2 to at least one or more pipelines (not shown) located on seafloor 3. Chaintable 6 is rigidly connected to rotatable mooring turret 7, which is then supported by dock frame 19 by means of an axial bearing and radial bearing system. Located on top of turret 7 is gas and fluid swivel stack 8 that provides a rotating sealed connection through which multiple flow paths are established for conducting all required gas, fluids, and control signals to the seafloor pipelines. This arrangement for mooring terminal 1 to seafloor 3 is appropriate for water depths of about 40 meters and deeper.

The open structure dock frame 19 comprises buoyant columns 20, a series of diagonal members 21, and buoyant horizontal structural members (pontoons) 22. Members 20, 21, and 22 are sealed from intrusion by the sea, are buoyant and serve to support terminal 2 while also containing compartments for ballast, pumps, and other ancillary equipment. Drop-in deck sections 23 are attached as individual modules to the top of dock frame 19. The various process modules comprising process equipment 9 are attached to deck sections 23. One or more reversible marine thrusters 13 are located on the aft end of dock frame 19 for the purpose of moving terminal 2 around a mooring point established by turret 7 and anchor legs 4. Pneumatic fenders 17, or other types of compliant marine docking fenders, are located along the side of dock frame 19 and attached by fender supports 18. Hawser pull-in winch system 30 is optimally located on the extreme forward end of dock frame 19.

In one embodiment of the invention, vaporizers 9 (also known as heat exchangers) are mounted on the floating terminal 2. The vaporizers 9 utilize seawater for warming the LNG offloaded from a carrier vessel 1 docked thereto. A very large volume of water is required for its operation. For example, when warming 7,500 m3 LNG per hour to a temperature of approximately 40° F., seawater flow rates are about 330,000 gal/min. Discharge piping is arranged underwater in a manifold of thirty-six 10" nozzles 32 (see FIG. 3*b*). When operating at 10 psig, then about 50,000 lb of hydraulic thrust is achieved when all nozzles are pointed in the same direction. Location of this nozzle diffuser arrangement 32 near the aft end of the dock structure, with nozzles pointed laterally away from the LNG terminal 2 and perpendicular to the carrier vessel, cause the terminal 2 to be forced toward the carrier 1. Such force helps maintain the two vessels (the terminal 2 and the carrier 1) together in a side-by-side orientation for a beneficial result of reducing loads on the carrier mooring lines and reducing the tendency of the carrier to drift away from the dock. Such arrangement of nozzles 32 also serves to disperse and mix the cooler water output from the heat exchanger into a larger area for improved environmental considerations. Additional mixing can be achieved if the diffuser nozzles are located near, or pointed close to the aft thrusters so that the thrusters can be run at partial capacity.

Figure 3C:
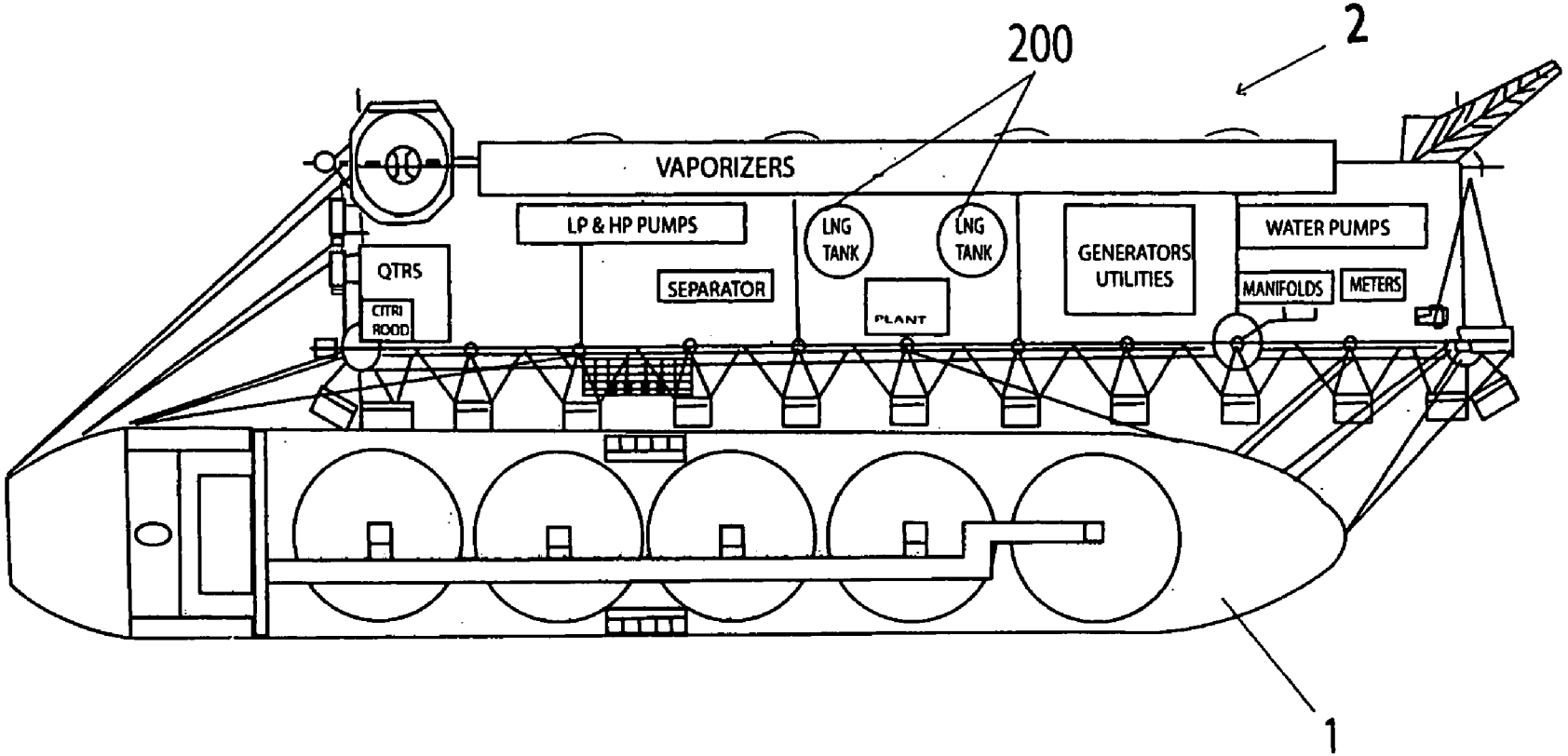

FIG. 3*c* presents a top plan view of an alternative embodiment 2' of the LNG terminal, with an LNG carrier vessel 2 moored along side, where the LNG terminal 2' includes LNG storage tanks 200 for temporary storage of LNG from the carrier vessel prior to the LNG being applied to the regasification equipment on board the LNG terminal.

Figure 4A:
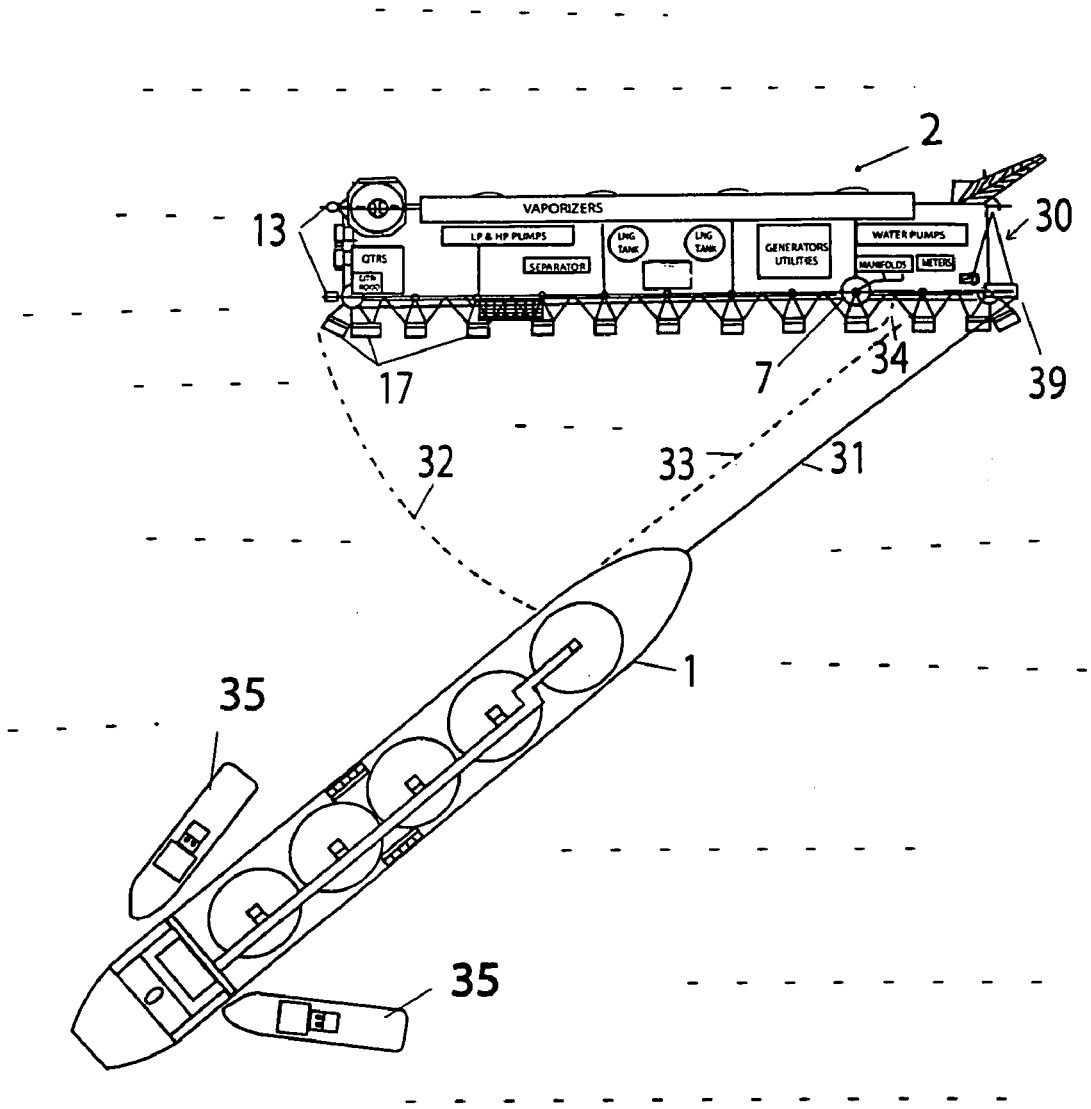

FIG. 4*a* illustrates the initial process of mooring an approaching LNG carrier to terminal 2. Hawser 31 is carried out to carrier 1 by tugboat 35 and attached to the bow chock of carrier1. Terminal 2 is rotated away from approaching carrier 2 by means of thruster(s) 13 until the angle between the two floating bodies 1, 2 is about 30 to 45°. Winch system 30 pulls in hawser 31 and carrier 1 slowly while one or more tugboats 35 maintain alignment of carrier 1. LNG carrier 1 can apply some reverse thrust while being pulled forward toward terminal 2. It is desirable that when terminal 2 is swung back around to carrier 1, the aft fenders 17 contact carrier 1 initially. To visualize this operation most accurately, consider reference line 33 which is tangent to the side of the carrier 1. It should lie outside of fender arc of travel 34; therefore the position of fairlead 39 is placed forward enough so that when there is about 40° angle between terminal 2 and carrier 1, the distance to the hawser centerline exceeds fender radius 34 plus half the breadth of the largest expected LNG carrier 1. The hawser pulling force tends to swing terminal 2 away from carrier 1, and this can be beneficial from the safety point of view. However in normal operation thrusters 13 keep terminal 2 in a relatively constant position control this action.

Figure 4B:
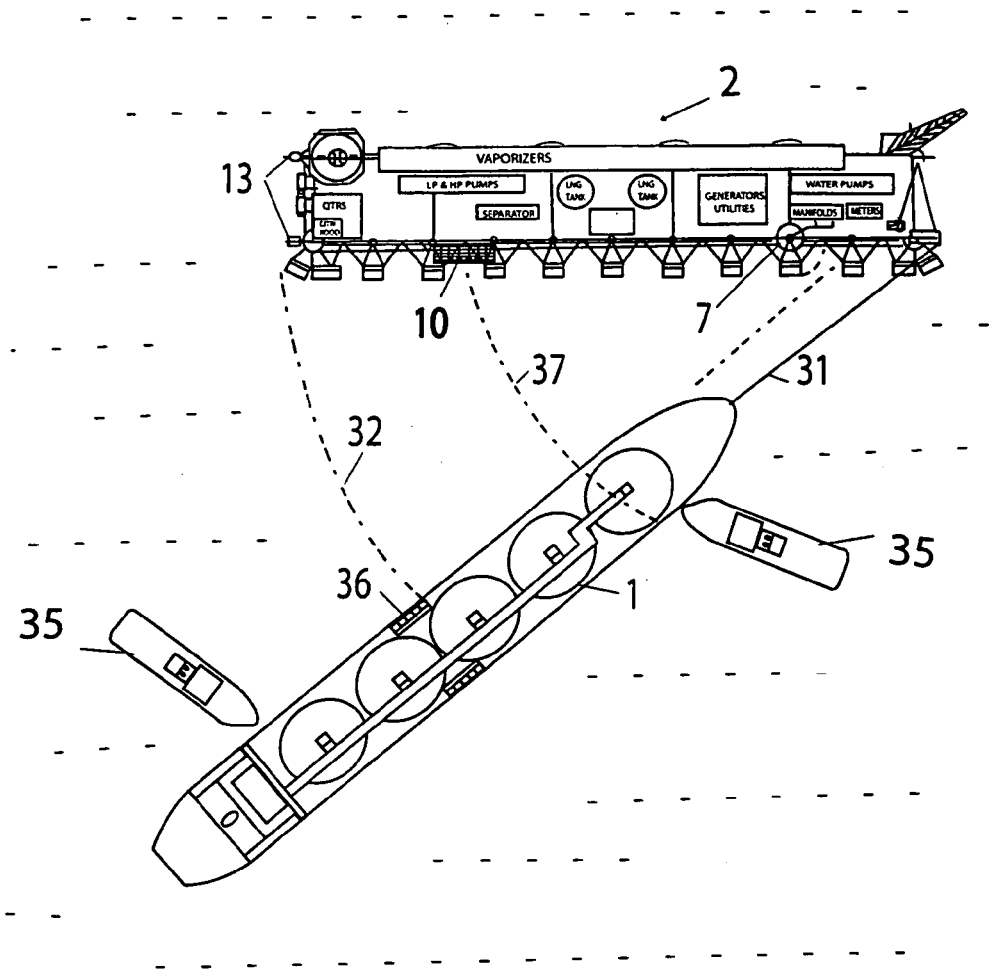

FIG. 4*b* shows carrier 1 approaching closer to terminal 2, and being assisted by tugboats 35. Large LNG carriers may have their own thrusters for positioning, and in that case tugs 35 are not required. Arc of travel 37 indicates the eventual position of loading arms 10 as required for final alignment with LNG carrier manifold 36. In this figure, forward motion of carrier 1 has been stopped by carrier's reverse thrust, or as assisted by tugs 35. Tension in hawser 31 is slacked off slowly to allow terminal 2 to begin rotating back around toward carrier 1.

Figure 4C:
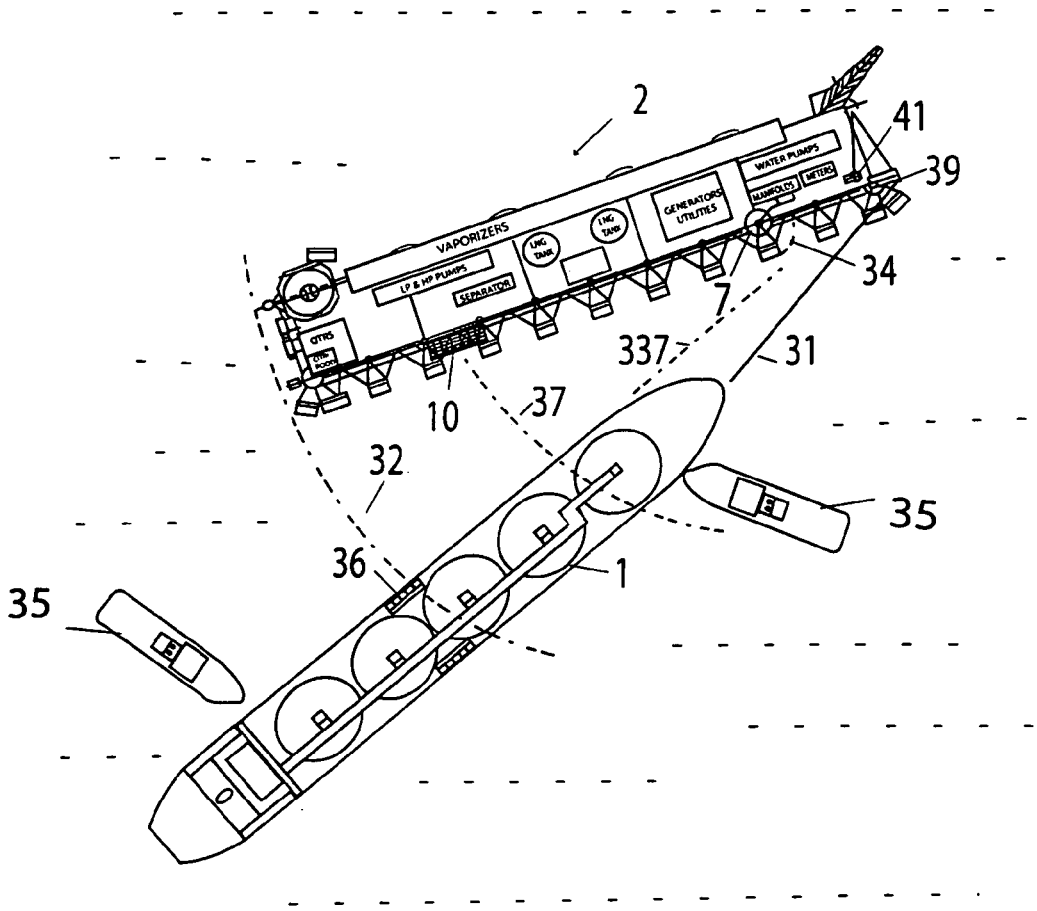

FIG. 4*c* illustrates terminal 2 approaching now stationary carrier 1 while hawser 31 is allowed to pay out slowly from winch 41 as terminal 2 rotates hawser fairlead 39 away from carrier 1.

Figure 4D:
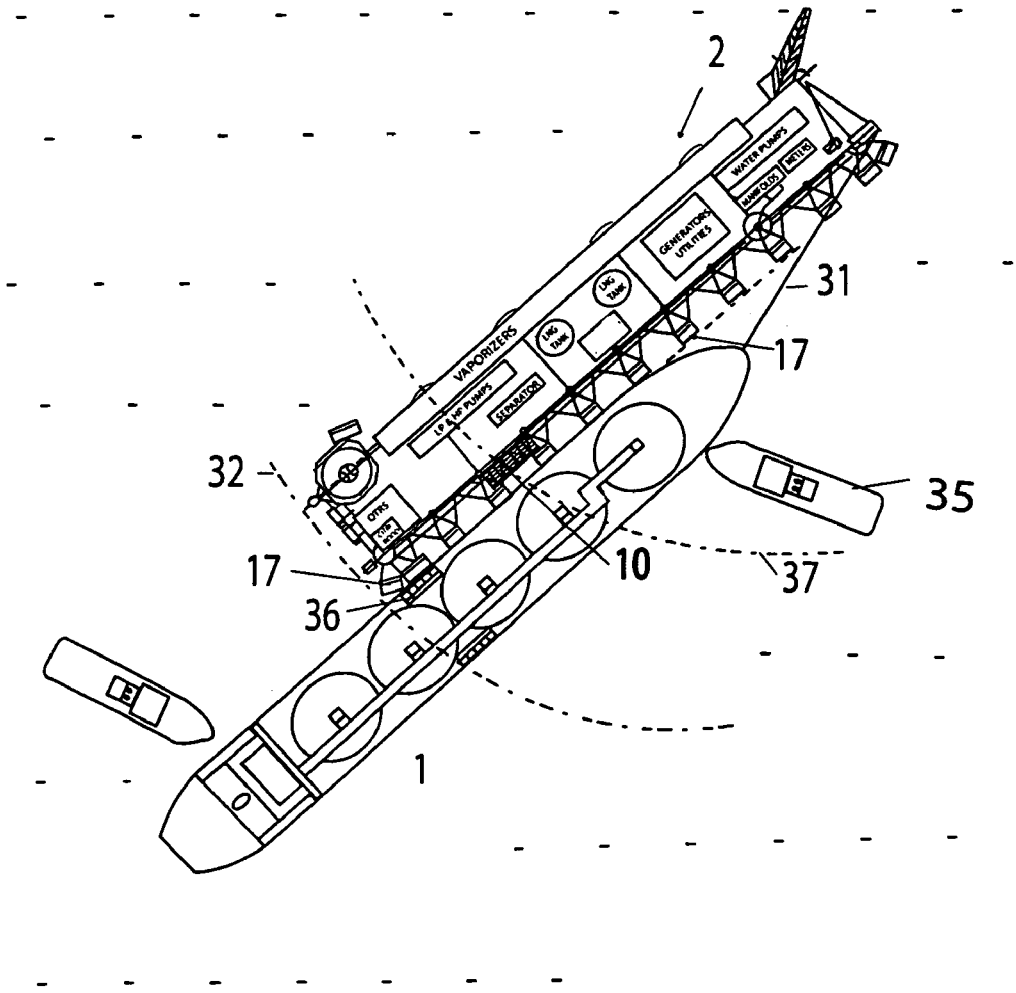

FIG. 4*d* indicates the approximate position of contact between fenders 17 and carrier 1, advantageously at approximately midship where the relative motion of carrier 1 and terminal 2 is the least. At this point it is necessary to pull carrier 1 forward to align loading arms 10 with manifold 36.

Figure 4E:
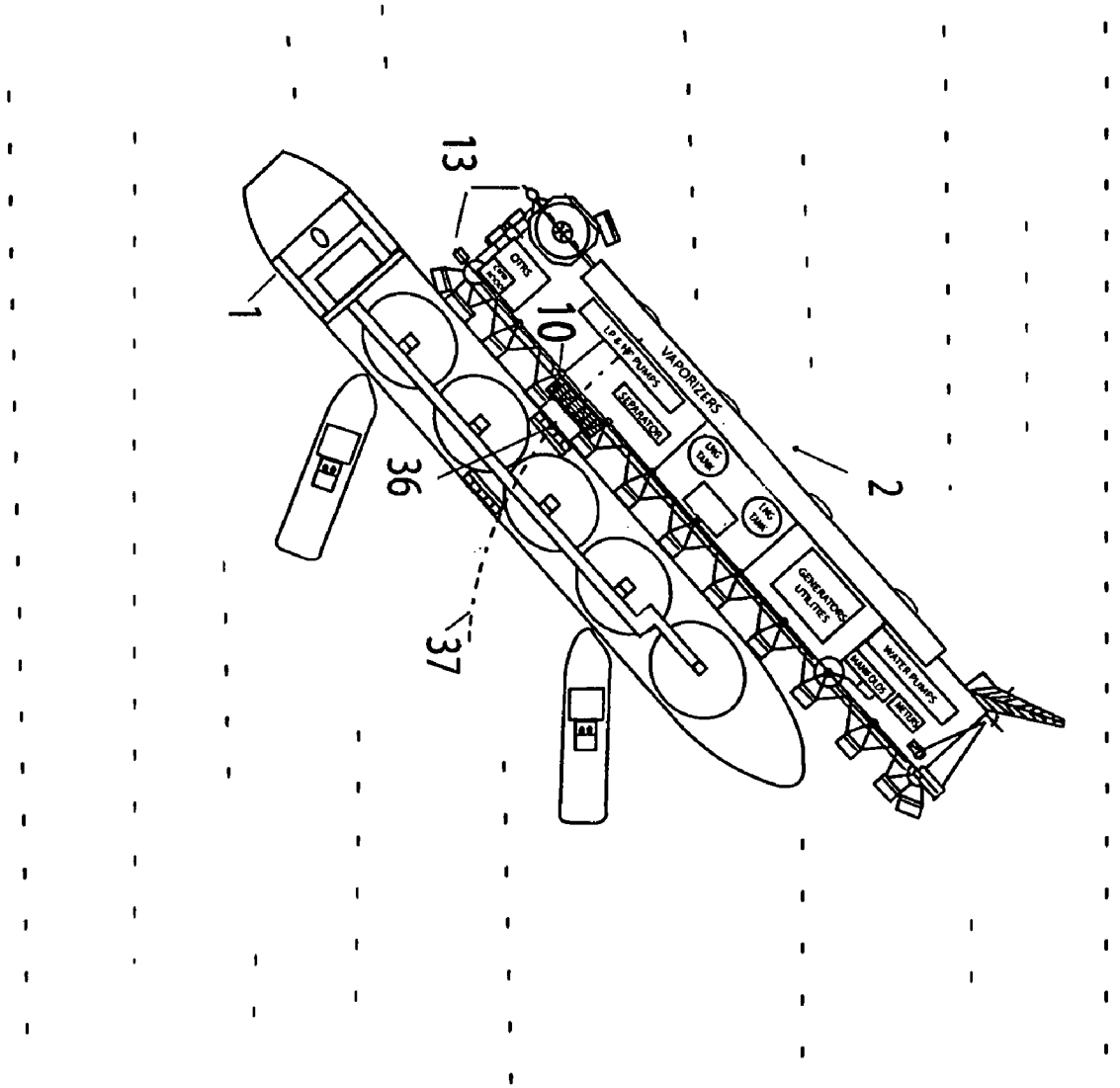

FIG. 4*e* shows carrier 1 positioned for connection of loading arms 10 to carrier manifold 36, and ready for attachment of carrier mooring lines to terminal 2.

Figure 5A:
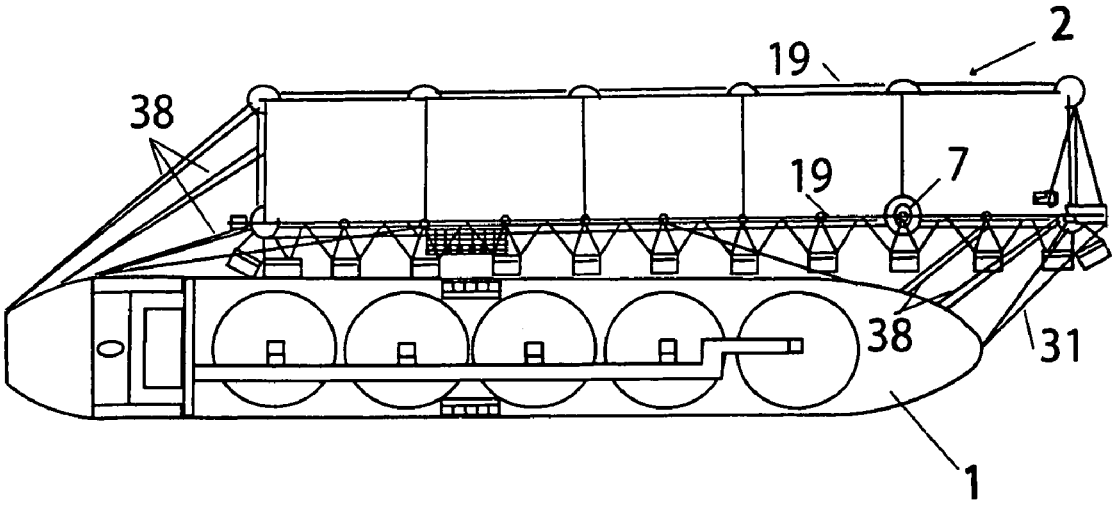
Figure 5B:
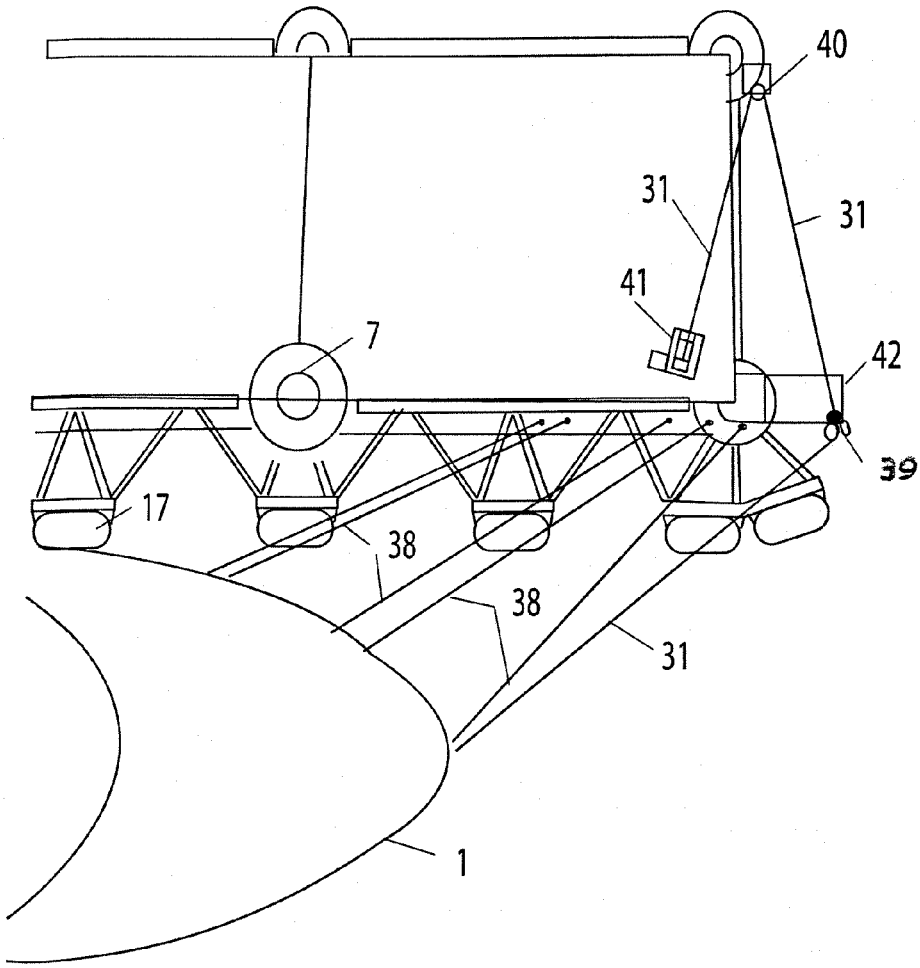

FIG. 5*a* shows carrier 1 fully moored to terminal 2 by means of multiple lines 38 attached forward and aft to cleats, or to quick release hooks, on dock frame 19. Lines 38 in addition to hawser 31 secure the two floating bodies 1, 2 together while the LNG offloading process takes place. The placement of mooring lines is in accordance with industry standards, such as the OCIMF Equipment Guidelines. A significant portion of the total mooring load is held by hawser 31 and this feature adds holding capacity to the standard OCIMF mooring line arrangement FIG. 5*b* is an enlarged view of the mooring arrangement at the bow of carrier 1. Hawser 31 is routed through swiveling fairlead 34, around sheave 40 and back to winch 41. The advantage of this arrangement is to increase the loaded length of hawser with the carrier moored, thereby maintaining sufficient elasticity, or spring, in the hawser. This beneficially reduces shock loading in hawser 31 when carrier 1 is in close proximity to fairlead 34.

Figure 6A:
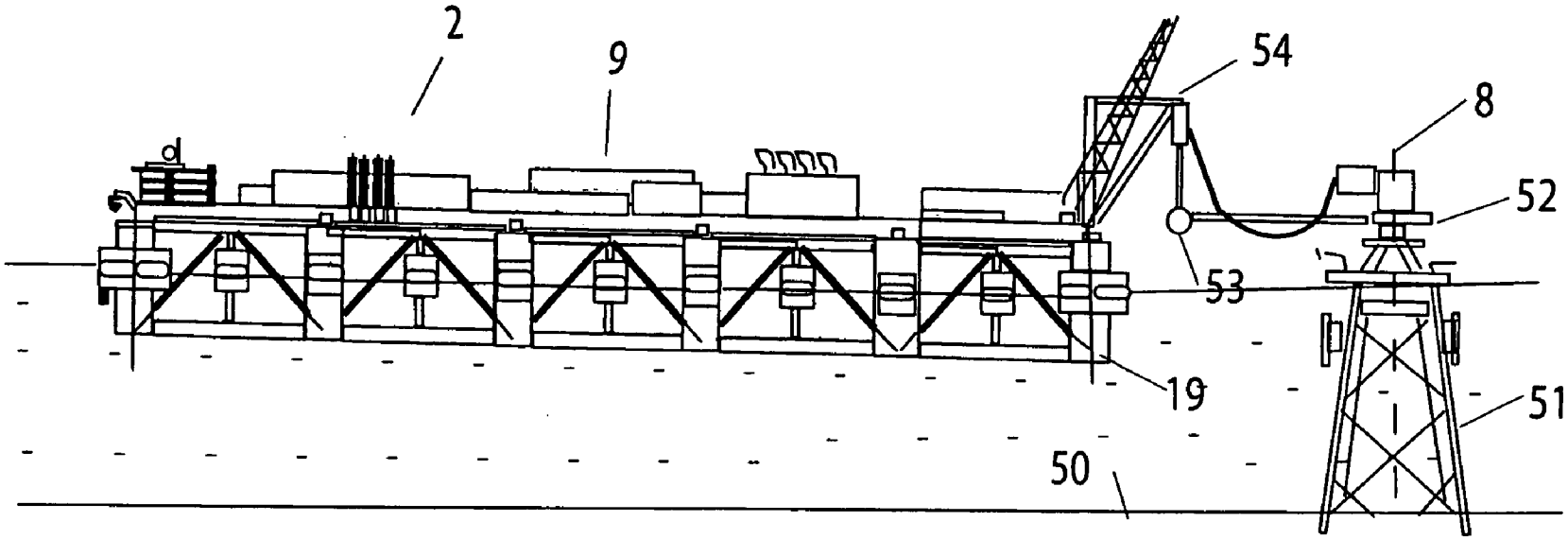

FIG. 6*a* is a side elevation view of terminal 1 anchored to seafloor 50 by means of a tower 51, turntable 52, soft yoke 53, and yoke support structure 54 attached to dock frame 19. This arrangement is appropriate for shallow water in the range of about 15 to 40 meters.

Figure 6B:
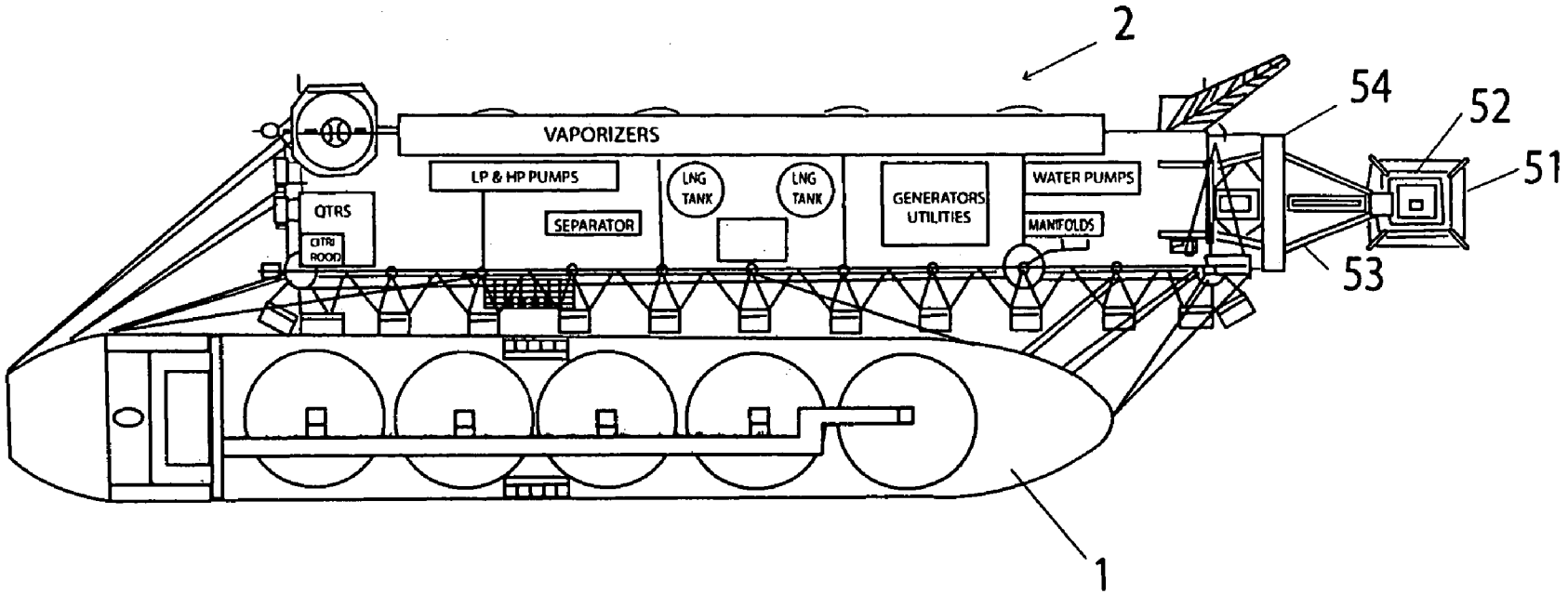

FIG. 6*b* is a top elevation view of the yoke moored terminal 1 of FIG. 6*a*. The center of mooring established by tower 51 and turntable 52 is shown approximately on the centerline of terminal 2. However an improved arrangement places the center of mooring to the side nearest carrier 1, to enhance the sea keeping characteristic of terminal 2 while carrier 1 is attached.

What is claimed is:

1. A terminal for offloading product at sea comprising, an open frame floating structure having first and second ends and a mid-point positioned half way between said first and second ends, said floating structure further having a longitudinal center line between said first and second ends, a deck mounted on the open frame floating structure above sea surface, a mooring turret rotatably mounted with respect to said open frame floating structure said mooring turret being an internal turret positioned at a lateral side of said floating structure away from said center line, at a position in proximity to said first end of said floating structure, anchor legs connected between said mooring turret and a sea floor so that said floating structure can weathervane about said mooring turret in response to environmental forces of waves, wind and current, and thrusters mounted at said second end of said open frame floating structure, whereby said thrusters are designed and arranged to provide torque to said floating structure with respect to said mooring turret position for swinging said second end of said open frame floating structure in an arc away from or toward a line defined generally by the path of an approaching carrier vessel with said first end of said open frame floating structure.

2. The terminal of claim 1 wherein said floating structure is designed and arranged to offload Liquefied Natural Gas (LNG) from a carrier vessel docked thereto.

3. The terminal of claim 2 further comprising a vaporizer mounted on said deck, whereby LNG offloaded from a carrier vessel is warmed to a gaseous state.

4. The terminal of claim 3 wherein said vaporizer includes underwater discharge nozzles pointed laterally away from the floating structure of the terminal and perpendicular to a carrier vessel docked thereto, thereby providing force to said terminal toward said carrier.

5. The terminal of claim 3 further comprising at least one cryogenic tank on said deck for storage of liquefied natural gas, wherein LNG being unloaded from carrier vessel is temporarily stored on the floating structure of said terminal prior to its gasification.

6. The terminal of claim 3 further comprising a pipeline connected between said terminal and an on-shore location.

7. The terminal of claim 3 further comprising a pipeline connected between said terminal and an underground storage cavern.

8. The terminal of claim 1 wherein said anchor legs are non-disconnectably secured to said mooring turret for deep water operations.

9. The terminal of claim 1 wherein said anchor legs are disconnectably secured to said mooring turret for deep water operations and are designed and arranged so that said terminal can be rapidly disconnected from said sea floor under conditions of approaching severe storms, ice flows, or icebergs.

10. The terminal of claim 1 further comprising a hawser fairlead sheave mounted forward of said mooring turret.

11. The terminal of claim 10 further comprising a winch carried by said open frame floating structure, and a hawser coupled to said winch and threaded through said fairlead sheave, said hawser designed and arranged for connecting to said carrier vessel.

12. The terminal of claim 1 wherein said open frame structure includes buoyant columns, connected with diagonal and horizontal buoyant members.

13. The terminal of claim 12 wherein said buoyant column, diagonal and horizontal members are arranged and designed to hold ballast, pumps, and ancillary equipment.

14. The terminal of claim 1 wherein said mooring turret is located from said first end within a range of about zero to thirty percent of the entire length of said floating structure.

15. The terminal of claim 1 wherein said mooring turret is positioned between said mid-point and said first end of said floating structure.

16. A terminal for offloading product at sea comprising an open frame floating structure having first and second ends and a mid-point positioned half way between said first and second ends, said floating structure further having a longitudinal center line between said first and second ends, a deck mounted on the open frame floating structure above sea surface, a mooring arrangement secured to a sea floor and rotatably coupled to said floating structure at a position between said mid-point and said first end of said structure so that said floating structure can weathervane in response to environmental forces of waves, wind, and current, wherein said mooring arrangement is an internal turret positioned at a lateral side of said floating structure away from said center line thrusters mounted at said second end of said open frame floating structure, whereby said thrusters are designed and arranged to provide torque to said floating structure with respect to said mooring turret position for swinging said second end of said open frame floating structure in an arc away from or toward a line defined generally by the path of an approaching carrier vessel with said first end of said open frame floating structure.

* * * * *